US010004944B2

(12) United States Patent
Wang

(10) Patent No.: US 10,004,944 B2
(45) Date of Patent: Jun. 26, 2018

(54) HOOKING AND LOCKING DEVICE FOR ELEVATING FOOTBOARD OF PULL-UP EXERCISE MACHINE

(71) Applicant: Leao Wang, Taichung (TW)

(72) Inventor: Leao Wang, Taichung (TW)

( * ) Notice: Subject to any disclaimer, the term of this patent is extended or adjusted under 35 U.S.C. 154(b) by 59 days.

(21) Appl. No.: 15/207,505

(22) Filed: Jul. 12, 2016

(65) Prior Publication Data

US 2018/0015325 A1 Jan. 18, 2018

(51) Int. Cl.

| | |
|---|---|
| ***A63B 23/12*** | (2006.01) |
| ***A63B 1/00*** | (2006.01) |
| ***A63B 21/00*** | (2006.01) |
| ***A63B 23/035*** | (2006.01) |

(52) U.S. Cl.

CPC ..... *A63B 23/1218* (2013.01); *A63B 1/00* (2013.01); *A63B 21/00047* (2013.01); *A63B 23/03525* (2013.01)

(58) Field of Classification Search

CPC ..... A63B 23/1218; A63B 23/03525
See application file for complete search history.

(56) References Cited

U.S. PATENT DOCUMENTS 3,156,465 A * 11/1964 Jacobi ..... A63B 23/12 182/136
3,614,097 A * 10/1971 Blickman ..... A63B 17/00 482/102

* cited by examiner

*Primary Examiner* — Loan H Thanh
*Assistant Examiner* — Rae Fischer

(57) ABSTRACT

A mandatory hooking/locking device for an elevating footboard of a pull-up exercise machine includes a touch-pressing rod disposed at stepping positions with respect to an exerciser's two soles separately and acted by a rotary plate and a torsion spring to achieve a lifting effect to freely penetrate and slightly elevate from an end surface of the elevating footboard, and a hooking portion disposed at the bottom end of the rotary plate being provided for hooking to a corresponsive latch column of an inwardly extending section in the floor affixing front stand, so that the hooking portion of the rotary plate can be separated from the latch column only if the two touch-pressing rods are stepped and pressed down simultaneously, so that the elevating footboard performs the expected ascending and descending motions to ensure the safety of use.

2 Claims, 4 Drawing Sheets

HOOKING AND LOCKING DEVICE FOR ELEVATING FOOTBOARD OF PULL-UP EXERCISE MACHINE

BACKGROUND OF THE INVENTION

1. Fields of the Invention

The present invention relates to a mandatory hooking/locking device for an elevating footboard of a pull-up exercise machine, more particularly to a novel invention capable of ensuring the safety of using exercise machines and equipments of the same type.

2. Description of the Related Art

The so-called "pull-up exercise machine" refers to an exclusive exercise/fitness equipment comprising an elevating footboard provided for an exerciser to stand thereon and a gripping end or a suspension-ring end disposed above a base to simulate a horizontal bar exercise or a gymnastic ring exercise, and the elevating footboard includes an accessory lifting member such as a spring or a hydraulic cylinder for constantly providing an upward trust to assist the exerciser to perform the intended exercise easily.

Since the lifting member constantly provides the upward trust to the elevating footboard, there is no inconvenience to the exerciser at all under the normal use of the pull-up exercise machine, except at the moment when the exerciser steps on the elevating footboard or leaves the elevating footboard. Therefore, the key is to provide a design capable of situating the elevating footboard at the relative lowest position without being affected by the lifting member when no force is exerted onto the elevating footboard, so that the exerciser can step on the footboard easily. When the exerciser wants to leave the elevating footboard, the elevating footboard will not move upward unexpectedly to jeopardize the safety of use. Therefore, manufacturers of the related industry strive endlessly to pursue and meet the aforementioned safety requirement.

SUMMARY OF THE INVENTION

An object of the invention is to provide a mandatory hooking/locking device to fully comply with the basic safety requirement of the exercise machines and equipments of the same type, so as to set the design specification to intangibly eliminate the potential risk of use.

According to the invention, a mandatory hooking/locking device for an elevating footboard of a pull-up exercise machine includes a touch-pressing rod disposed at stepping positions with respect to an exerciser's two soles separately and acted by a rotary plate and a torsion spring to achieve a lifting effect to freely penetrate and slightly elevate from an end surface of the elevating footboard, and a hooking portion disposed at the bottom end of the rotary plate being provided for hooking to a corresponsive latch column of an inwardly extending section in the floor affixing front stand, so that the hooking portion of the rotary plate can be separated from the latch column only if the two touch-pressing rods are stepped and pressed down simultaneously, so that the elevating footboard performs the expected ascending and descending motions to ensure the safety of use.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
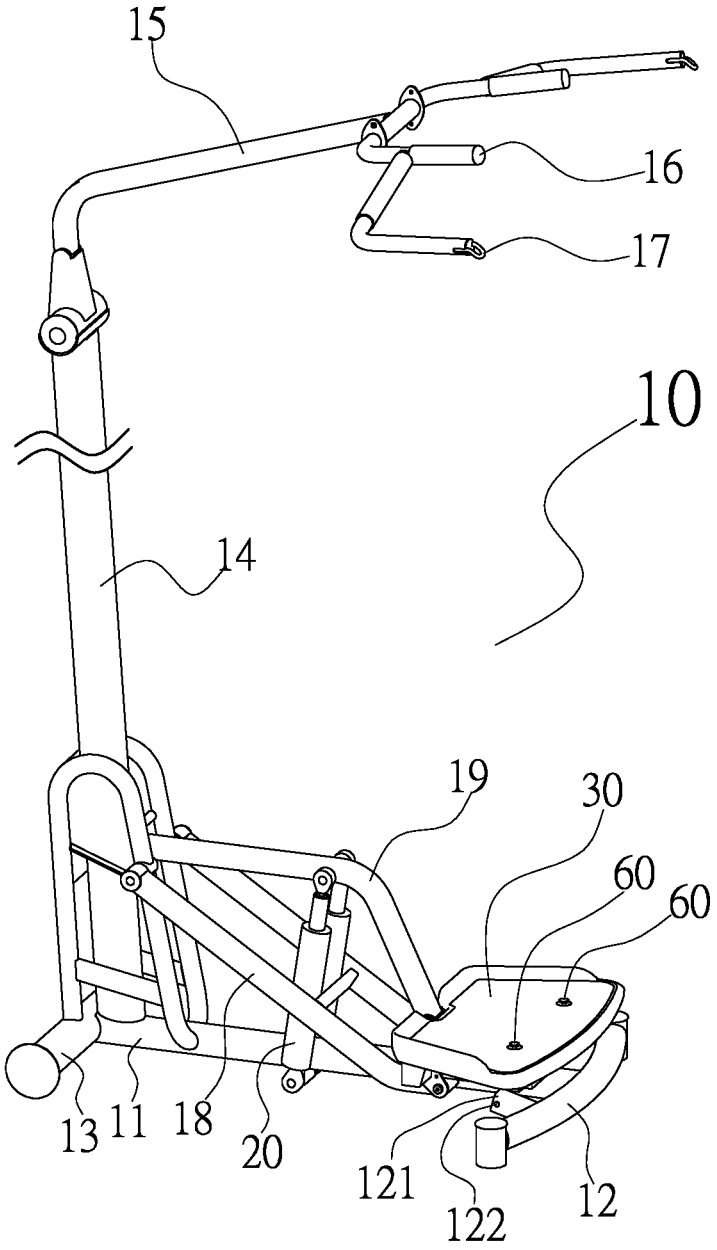
FIG. 1 is a perspective view of a preferred embodiment of the present invention.
Figure 3:
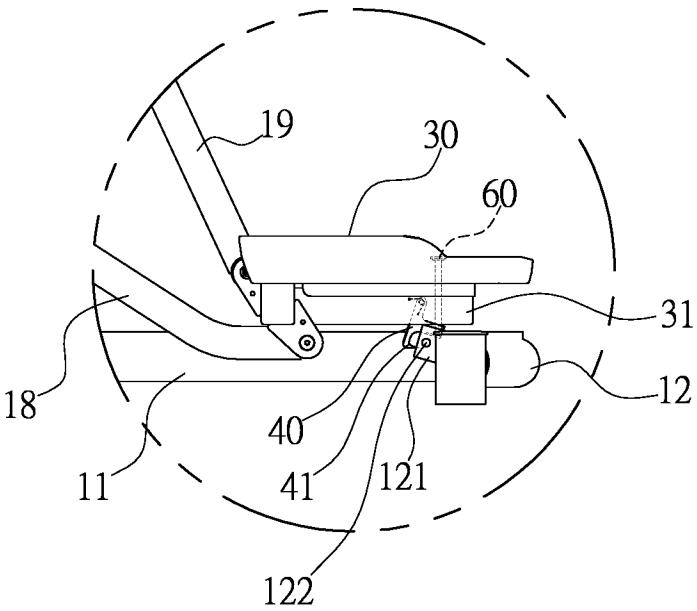
FIG. 3 is a schematic view of an operation of the present invention as depicted in FIG. 2.
Figure 2:
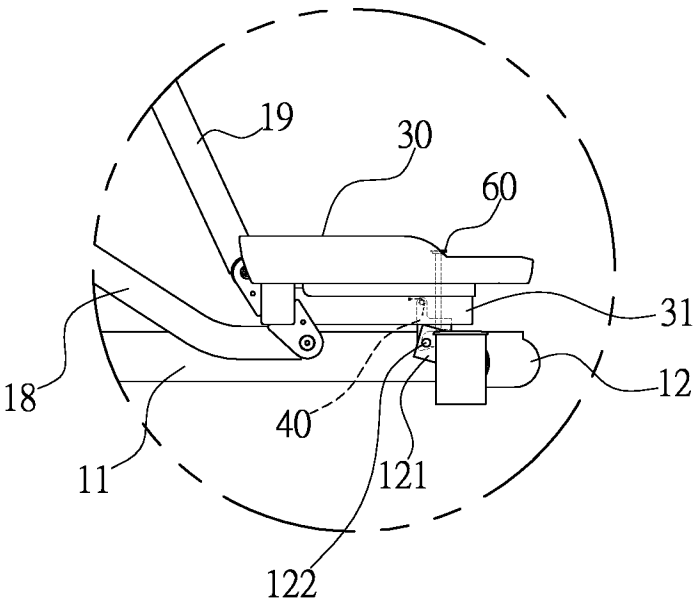
FIG. 2 is a schematic partial planar view of an installing position of the present invention.

The technical measures and characteristics of the present invention will become clearer in light of the following detailed description of an illustrative embodiment of this invention described in connection with the drawings.

With reference to FIGS. 1 to 5 for a pull-up exercise machine in accordance with a preferred embodiment of the present invention, the invention is applied to a pull-up exercise machine, and the pull-up exercise machine 10 comprises a floor affixing base 11 having front and rear stands 12, 13, a vertical stand 14 disposed at a position near a side of the rear stand 13, a top oblique stand 15 having a gripping end 16 and a suspension-ring end 17 and coupled to the top end of the vertical stand 14, a dual lifting link rod 18 and a footboard link rod 19 pivotally coupled to a position near the bottom of the vertical stand 14, and an auxiliary lifting member 20 pivotally coupled between the floor affixing base 11 and the footboard link rod 19, so as to constantly provide a lifting effect to the footboard link rod 19, and the other ends of the dual lifting link rod 18 and the footboard link rod 19 are pivotally coupled to a horizontally elevatable and displaceable elevating footboard 30, characterized in that the elevating footboard 30 has a touch-pressing rod 60 disposed at stepping positions with respect to an exerciser's two soles separately and acted by a rotary plate 40 and a torsion spring 50 to provide a lifting effect to freely penetrate and slightly elevate from an end surface of the elevating footboard 30, and a hooking portion 41 disposed at the bottom end of the rotary plate 40 is provided for hooking a corresponsive latch column 122 to latch an inwardly extending section 121 in the front stand 12, so that the hooking portion 41 of the rotary plate 40 can be separated from the latch column 122 only if the two touch-pressing rods 60 are stepped and pressed down by the exerciser's feet simultaneously, so as to drive the elevating footboard 30 to perform the expected ascending and descending motions.

Figure 5:
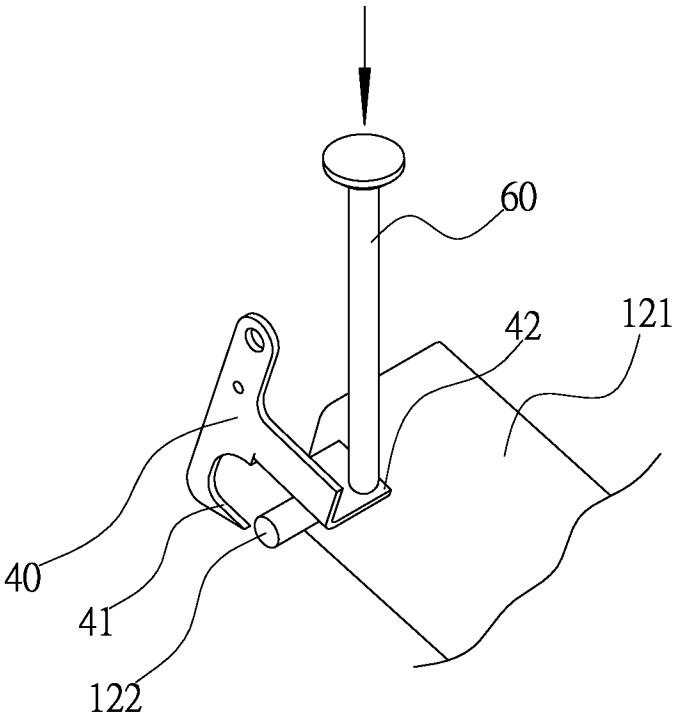
FIG. 5 is a schematic view of an operation of a mandatory hooking/locking device as depicted in FIG. 4.
Figure 4:
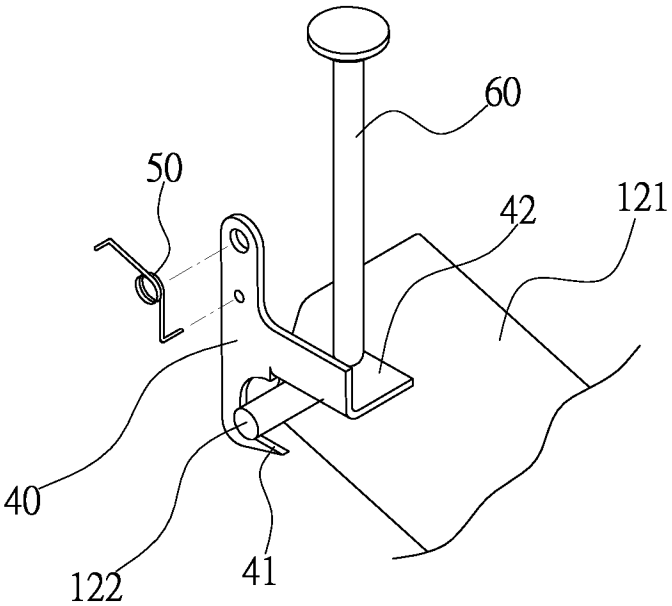
FIG. 4 is a perspective view of a mandatory hooking/locking device of the present invention.

The rotary plate 40 operated in coordination with a torsion spring 50 is pivotally coupled to an inner side of a side frame 31 at the bottom of the elevating footboard 30, and a pressure bearing platform 42 is formed and bent from the middle section for touching the bottom of the touch-pressing rod 60. When the touch-pressing rod 60 is pressed down, a force is exerted onto the pressure bearing platform 42 to deflect the rotary plate 40, so as to separate the hooking portion 41 from the latch column 122 (as shown in FIG. 5). When the exerted force is released, the action of the torsion spring 50 resumes the rotary plate 40 to its original hooking position (as shown in FIG. 4).

In other words, the elevating footboard 30 has two touch-pressing rods 60 corresponsive to the exerciser's feet respectively. When the elevating footboard 30 is situated at the lowest position and the two touch-pressing rods 60 are not pressed down, the elevating footboard 30 is normally and stably hooked to stay still at the lowest position, so as to allow the exerciser to step on the elevating footboard 30. After the exerciser's feet have stepped on the elevating footboard 30 to press the two touch-pressing rods 60, the intended pull-up exercise can be preformed. When the exerciser wants to leave the pull-up exercise machine 10, the exerciser has to descend the elevating footboard 30 to the lowest position by the gravity of his/her body weight. Now, if any one of the exerciser's feet leaves the elevating footboard 30, the touch-pressing rod 60 at the corresponsive position will be elevated accordingly, and the rotary plate 40 will be switched to a mandatory hooking/locking status, so that the elevating footboard 30 will not have any unexpected elevation or motion. Such design not just facilitates the exerciser to leave the elevating footboard 30 only, but also ensures the safety of use. Since the pull-up exercise machine 10 is a prior art, and its operating method and the operating mode of the elevating footboard 30 are well known in the art, therefore they will not be described in details.

Figure 6:
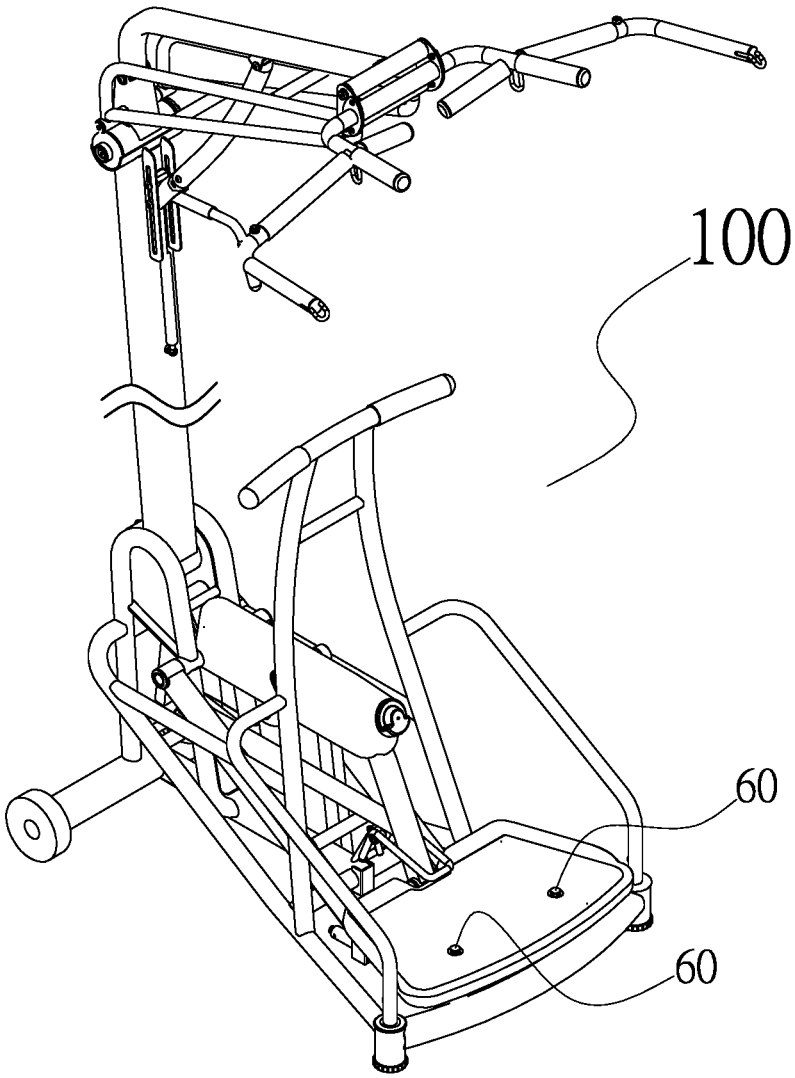
FIG. 6 is schematic view of a preferred embodiment of the present invention applied to another exercise equipment of the same type.

In FIG. 6, the present invention may be applied to any pull-up exercise machine 100 of the same type to achieve the same expected safety effect without causing any delay or hindrance.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A hooking and locking device for an elevating footboard of a pull-up exercise machine comprising:

a floor affixing base with front and rear stands;

a vertical stand installed on a side of the rear stand;

a top oblique stand having a gripping end and a suspension-ring end and coupled to the top end of the vertical stand;

a dual lifting link rod and a footboard link rod pivotally coupled to a position near the bottom of the vertical stand;

an auxiliary lifting member pivotally coupled between the floor affixing base and the footboard link rod; and the dual lifting link rod and the other end of the footboard link rod being pivotally coupled to a horizontally elevatable and displaceable elevating footboard, wherein the elevating footboard has a touch-pressing rod disposed at stepping positions with respect to an exerciser's two soles separately and acted by a rotary plate and a torsion spring to provide a lifting effect to freely penetrate and slightly elevate from an end surface of the elevating footboard, and wherein a hooking portion disposed at the bottom end of the rotary plate being provided for hooking to a corresponsive latch column of an inwardly extending section in the floor affixing front stand, so that the hooking portion of the rotary plate can be separated from the latch column only if the two touch-pressing rods are stepped and pressed down simultaneously.

2. The hooking and locking device for an elevating footboard of the pull-up exercise machine of claim 1, wherein the rotary plate operated in coordination with a torsion spring is pivotally coupled to an inner side of a side frame at the bottom of the elevating footboard, and a pressure bearing platform is formed and bent from the middle section for touching the bottom of the touch-pressing rod.

* * * * *